US008967160B2

(12) United States Patent
Kim

(10) Patent No.: US 8,967,160 B2
(45) Date of Patent: Mar. 3, 2015

(54) REMOVABLE HAIR CLIP FOR HAIR IRON

(71) Applicant: B2Y, Inc., Chungcheongnam-do (KR)

(72) Inventor: Hae-Jin Kim, Seoul-si (KR)

(73) Assignee: B2Y, Inc., Chungcheongnam-Do (KR)

( * ) Notice: Subject to any disclaimer, the term of this patent is extended or adjusted under 35 U.S.C. 154(b) by 0 days.

(21) Appl. No.: 13/956,811

(22) Filed: Aug. 1, 2013

(65) Prior Publication Data

US 2014/0060569 A1 Mar. 6, 2014

(30) Foreign Application Priority Data

Sep. 4, 2012 (KR) ..... 20-2012-0007860 U

(51) Int. Cl.
*A45D 1/04* (2006.01)
*A45D 6/04* (2006.01)

(52) U.S. Cl.
CPC ..... *A45D 6/045* (2013.01)
USPC ..... 132/232

(58) Field of Classification Search
CPC ..... A45D 1/00; A45D 1/10; A45D 1/12; A45D 1/14; A45D 1/06; A45D 1/20; A45D 1/28; A45D 6/04; A45D 6/045; A45D 6/00
USPC ..... 132/226–232, 242, 250–252
See application file for complete search history.

(56) References Cited

U.S. PATENT DOCUMENTS

| | | | | | |
|---|---|---|---|---|---|
| 2,147,978 | A | * | 2/1939 | Kantor | 132/264 |
| 2,171,332 | A | * | 8/1939 | Freeman | 132/242 |
| 3,881,500 | A | * | 5/1975 | Shinbashi et al. | 132/252 |
| 4,513,761 | A | * | 4/1985 | Van Deursen | 132/251 |

FOREIGN PATENT DOCUMENTS

| | | |
|---|---|---|
| KR | 1020020009073 | 1/2002 |
| KR | 1020050103532 | 1/2005 |

* cited by examiner

*Primary Examiner* — Rachel Steitz
(74) *Attorney, Agent, or Firm* — Hoffmann & Baron, LLP

(57) ABSTRACT

A removable hair clip for a hair iron, which is used to hold the hair on a heating barrel of the hair iron when setting the hair and is configured to form a removable structure suitable for removably installing the hair clip on the heating barrel, so a user can use the hair iron with or without the hair clip, thereby avoiding an unnecessary interference of the hair clip with the hair. The removable hair clip that is installed on the heating barrel so as to be resiliently rotated relative to the barrel includes: a cylindrical holder having an opening removably installed around the heating barrel and rotatably installing the hair clip on the heating barrel; and a locking unit provided on the holder so as to removably install the holder on the heating barrel, thereby controlling a removable installation of the hair clip on the heating barrel.

5 Claims, 5 Drawing Sheets

REMOVABLE HAIR CLIP FOR HAIR IRON

CROSS-REFERENCE TO RELATED APPLICATIONS

This application claims priority from Korean Patent Application No. 20-2012-0007860 filed on Sep. 4, 2012.

BACKGROUND OF THE INVENTION

1. Field of the Invention

The present invention relates, in general, to removable hair clips for hair irons and, more particularly, to a removable hair clip for a hair iron which can be commonly used with various kinds of bar-shaped hair irons and can be selectively installed on a hair iron when necessary to set the hair.

2. Description of the Related Art

Generally, hair tools for making the hair beautiful are classified into hair dryers, hair brushes, hair irons, etc.

Hair dryers are used to make the hair dry by providing hot air that has been heated by high temperature heat generated by a heater to the hair, hair brushes are used to arrange the hair by combing, and hair irons are used to set the hair specifically by making the hair curly or by creating desired crimps in the hair using heat.

As shown in FIG. 1, a conventional bar-shaped hair iron that is one of a variety of typical hair tools includes: a handle 51 having an electric power supply unit therein, a heating barrel 53 integrated with the handle 51 into a single body and having a heater therein, and a hair clip 55 coupled to the heating barrel 53 such that the hair clip 55 can be resiliently rotated relative to the heating barrel 53, with a manipulation lever 55*a* integrated with the hair clip 55 so as to stably and effectively hold the hair on the heating barrel 53 when setting the hair.

When the conventional bar-shaped hair iron having the above-mentioned construction is used to set the hair by making the hair curly or by creating desired crimps in the hair, the hair clip 55 of the hair iron may be effectively used. However, when the hair iron is used for some purposes, the hair clip 55 may induce an unnecessary interference with the hair, thereby causing inconvenience to a user.

The foregoing is intended merely to aid in the understanding of the background of the present invention, and is not intended to mean that the present invention falls within the purview of the related art that is already known to those skilled in the art.

DOCUMENTS OF RELATED ART (Patent Document 1) Korean Patent Application Publication No. 2002-0009073(Invention Title: Electric Hair Iron); and (Patent Document 2) Korean Patent Application Publication No. 2005-0103532 (Invention Title: Iron for Hair Curling)

SUMMARY OF THE INVENTION

Accordingly, the present invention has been made keeping in mind the above problems occurring in the related art, and the present invention is intended to propose a hair clip for a hair iron, in which a hair clip that is used to hold the hair on the outer circumferential surface of a heating barrel when setting the hair is configured to form a removable structure such that the hair clip can be removably installed on the heating barrel of the hair iron, so when the hair iron is used for specified purposes requiring the use of the hair clip, a user can use the hair clip after installing the hair clip on the heating barrel and, when the hair iron is used for purposes that do not require the use of the hair clip, the user can use the hair iron after removing the hair clip from the heating barrel in an effort to avoid an unnecessary interference of the hair clip with the hair.

In order to achieve the above object, according to one aspect of the present invention, there is provided a removable hair clip for a hair iron, the hair clip being installed on a heating barrel of the hair iron such that the hair clip can be resiliently rotated relative to the heating barrel and can hold the hair on the heating barrel, the hair clip comprising: a cylindrical holder having an opening removably installed around an outer circumferential surface of the heating barrel and rotatably installing the hair clip on the heating barrel; and a locking unit provided on the holder so as to removably install the holder on the heating barrel, thereby controlling a removable installation of the hair clip on the heating barrel.

In the present invention, the locking unit may comprise: a locking lever rotatably coupled to a first end of the opening of the holder; and a locking loop rotatably coupled to the locking lever and selectively locked to a second end of the opening of the holder.

In the present invention, the holder may be provided with a locking hook in the second end thereof, the locking hook being bent outward such that the locking hook can lock the locking loop by hooking the locking loop.

The removable hair clip may further comprise: an anti-slip pad inserted into the cylindrical holder such that the anti-slip pad comes into contact with the outer circumferential surface of the heating barrel so as to restrict a rotation and movement of the holder relative to the heating barrel.

The present invention is advantageous in that it provides a removable hair clip that is removably installed on the heating barrel of the bar-shaped hair iron, so when the hair iron is used to set the hair, the hair iron can more stably and effectively hold the hair on the heating barrel using the hair clip, thereby realizing improved hair setting effects by making the hair curly and by creating crimps in the hair more effectively.

Another advantage of the present invention resides in that, when it is not required to use the hair clip while setting the hair, the hair clip can be removed from the heating barrel of the hair iron, thereby avoiding an unnecessary interference with the hair.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Hereinbelow, a preferred embodiment of the present invention will be described in detail with reference to the accompanying drawings.

Figure 1:
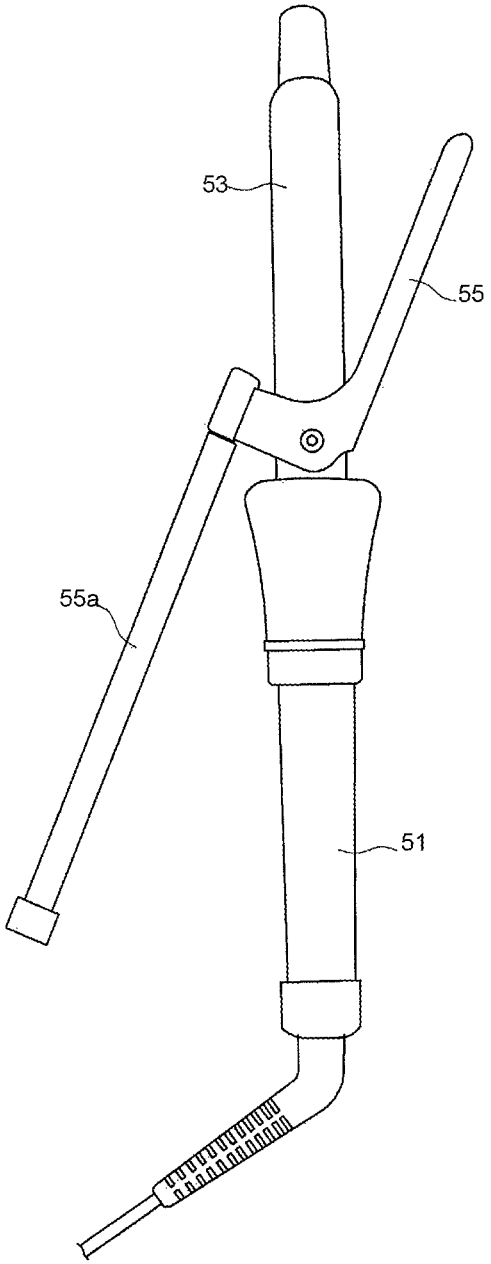
FIG. 1 PRIOR ART
FIG. 1 is a view illustrating a conventional bar-shaped hair iron.
Figure 2:
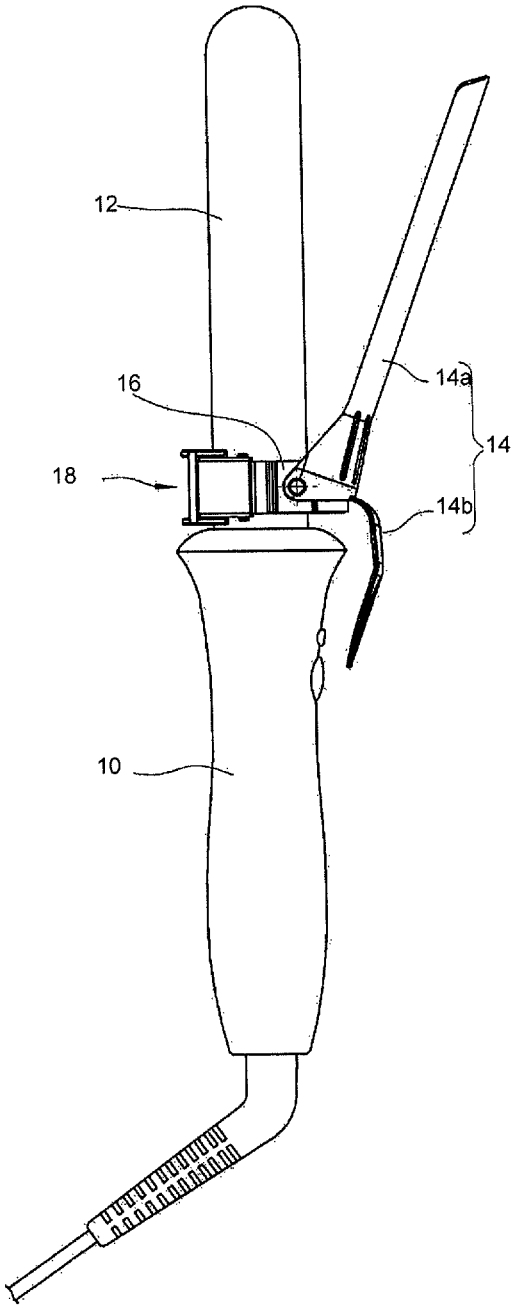
FIG. 2 is a view illustrating the use of a removable hair clip for a hair iron according to the present invention.

As shown in FIG. 2, a bar-shaped hair iron of the present invention includes a handle 10 having an electric power supply unit therein, and a heating barrel 12 integrated with the handle 10 into a single body and having a heater therein. In the present invention, a hair clip 14 is removably installed on the heating barrel 12 so as to more stably and effectively hold the hair on the heating barrel 12 when setting the hair by making the hair curly or by creating desired crimps in the hair.

The hair clip 14 includes a pressure clip body 14*a* that is installed on a holder 16 such that the clip body 14*a* can be resiliently rotated relative to the holder 16 and holds the hair on the heating barrel 12, and a manipulation lever 14*b* that can control the pressure of the pressure clip body 14*a* applied to the hair and can release the pressure clip body 14*a*. Here, the pressure clip body 14*a* and the manipulation lever 14*b* are integrated into a single body.

Figure 3:
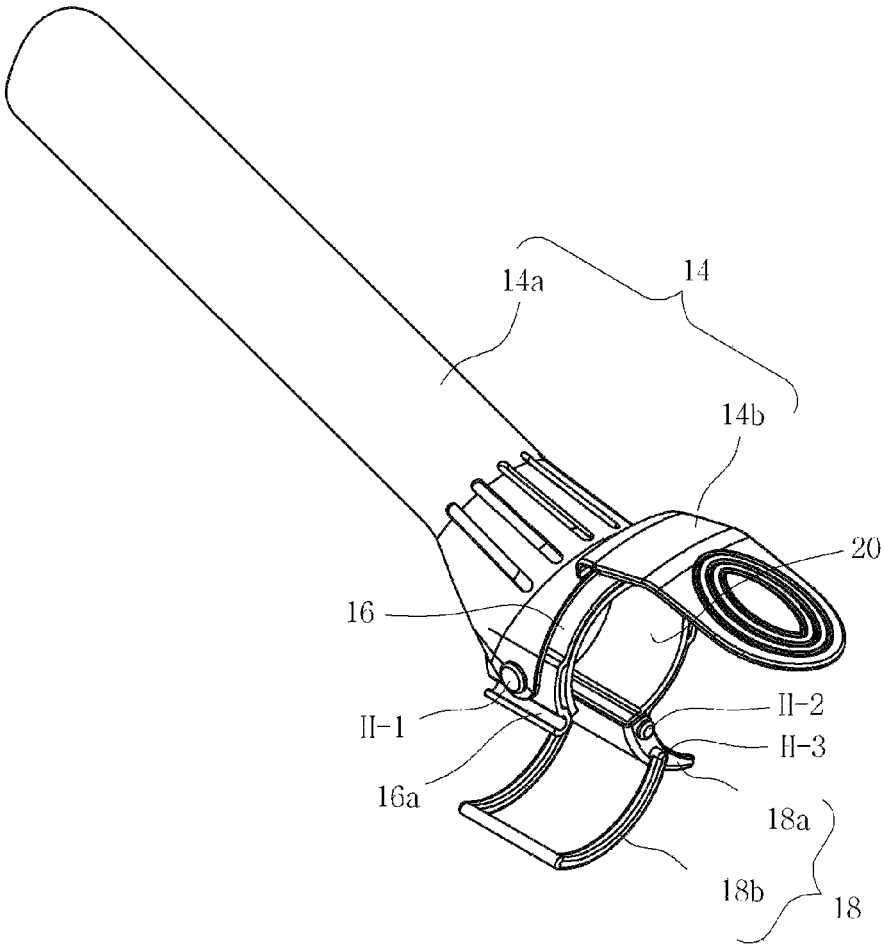
FIG. 3 is a perspective view illustrating a detailed construction of the hair clip removed from the hair iron of FIG. 2.
Figure 4:
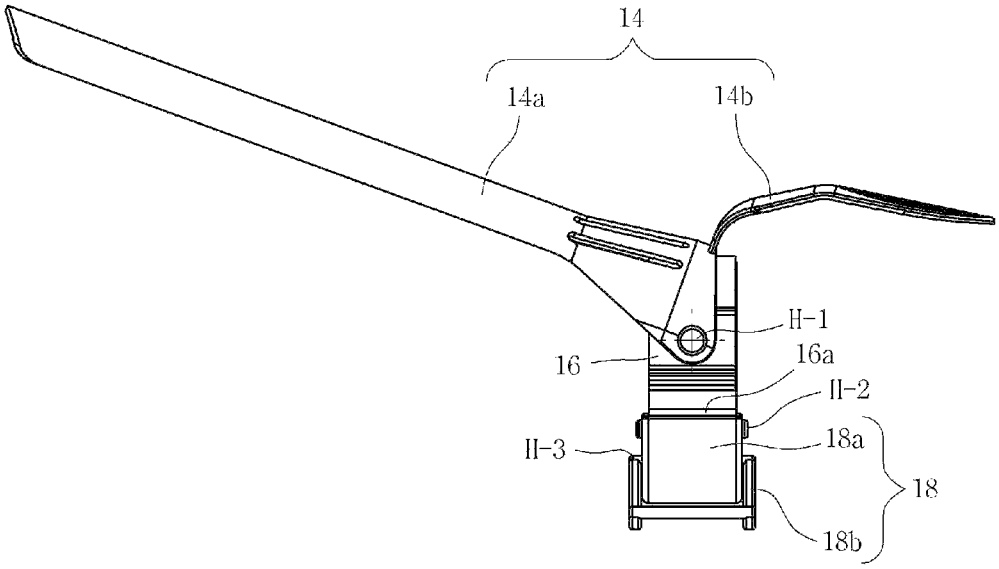
FIG. 4 is a front view illustrating the hair clip for the hair iron according to the present invention.
Figure 5:
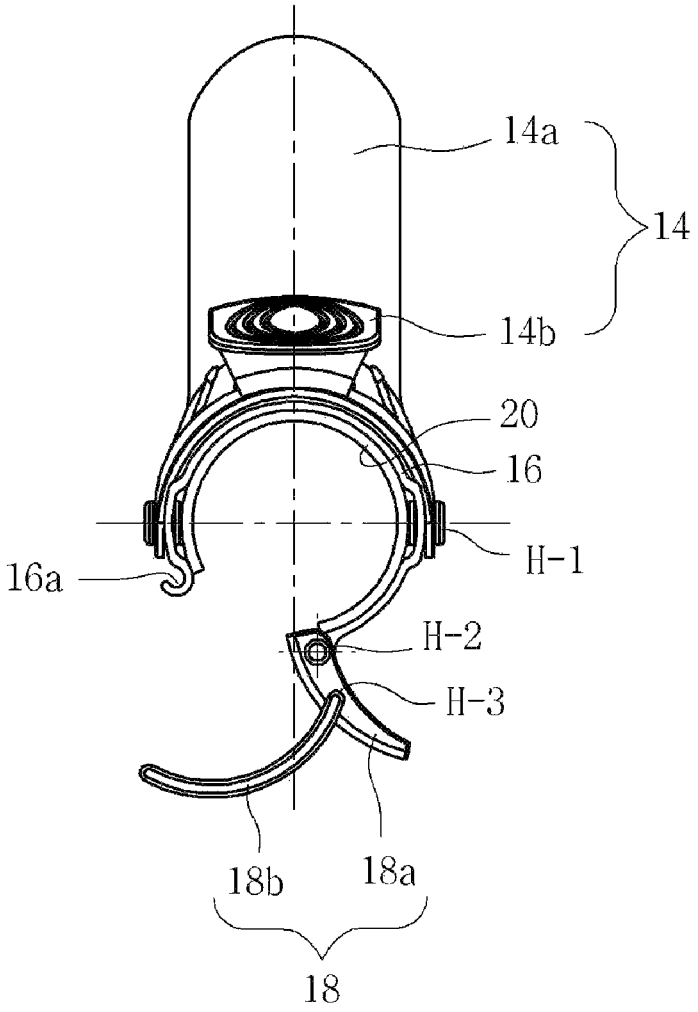
FIG. 5 is a side view illustrating the hair clip for the hair iron according to the present invention.

As shown in FIGS. 3 to 5, the holder 16 has a cylindrical structure having an opening which can be removably installed around the outer circumferential surface of the heating barrel 12. Thus, the holder 16 can removably install the hair clip 14 on the heating barrel 12, with both the pressure clip body 14*a* and the manipulation lever 14*b* rotatably mounted to a first hinge point H-1 of the holder 16. In this case, to realize the resilient rotation of the hair clip 14 relative to the holder 16, an elastic member (not shown), such as a torsion spring, is installed in the first hinge point H-1.

Further, to realize the removable installation of the hair clip 14 on the heating barrel 12 by removably installing the holder 16 on the heating barrel 12, the holder 16 is provided with a locking unit 18. The locking unit 18 includes a locking lever 18*a* that is rotatably coupled to the first end of the opening of the holder 16 using a second hinge point H-2, and a locking loop 18*b* that is rotatably coupled to the locking lever 18*a* using a third hinge point H-3.

In this case, the holder 16 is provided with a locking hook 16*a* that is integrally formed in the second end of the opening of the holder 16. The locking hook 16*a* is bent outward in the second end of the opening of the holder 16 such that the locking hook 16*a* can lock the free end of the locking loop 18*b* by hooking the locking loop 18*b*.

Further, the present invention further includes an anti-slip pad 20 that is inserted into the cylindrical holder 16 such that, when the holder 16 is tightened and locked to the heating barrel 12 by fastening the locking unit 18, the anti-slip pad 20 can come into close contact with the outer circumferential surface of the heating barrel 12, thereby restricting a rotation and movement of the holder 16 relative to the heating barrel 12.

That is, when the holder 16 is locked to the heating barrel 12 by fastening the locking unit 18, the holder 16 can be tightened to the outer circumferential surface of the heating barrel 12 by the anti-slip pad 20, so an unnecessary rotation and movement of the holder 16 relative to the heating barrel 12 can be restricted.

Accordingly, in the removable hair clip 14 of the present invention, the locking loop 18*b* can be tightly hooked by the locking hook 16*a* that is formed in the first end of the holder 16, by manipulating the locking lever 18*a* of the locking unit 18. As described above, the hair clip 14 of the present invention can be installed on the heating barrel 12 of the hair iron using the holder 16, so when setting the hair, the present invention can realize improved hair setting effects by making the hair curly or by creating desired crimps in the hair in a state in which the pressure clip body 14*a* of the hair clip 14 holds the hair on the heating barrel 12 more stably and effectively.

In this case, the anti-slip pad 20 that is placed around the inner circumferential surface of the holder 16 can effectively restrict the rotation and movement of the holder 16 relative to the heating barrel 12, so the hair clip 14 can more firmly hold the hair on the heating barrel 12, thereby further improving the hair setting effects of the hair iron.

Further, when the hair iron is used for purposes that do not require the use of the hair clip 14 when setting the hair, a user can use the hair iron after removing both the hair clip 14 and the holder 16 from the heating barrel 12 by releasing the locking unit 18, thereby avoiding an unnecessary interference of the hair clip 14 with the hair.

In addition, the hair clip 14 of the present invention is advantageous in that it can be commonly used with various kinds of bar-shaped hair irons using both the holder 16 and the locking unit 18, if the heating barrels 12 of the bar-shaped hair irons which have different shapes have the same diameter.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A removable hair clip for a hair iron, the hair clip being installed on a heating barrel of the hair iron such that the hair clip can be resiliently rotated relative to the heating barrel and can hold the hair on the heating barrel, the hair clip comprising:

a cylindrical holder having an opening removably installed around an outer circumferential surface of the heating barrel and rotatably installing the hair clip on the heating barrel; and a locking unit provided on the holder so as to removably install the holder on the heating barrel, thereby controlling a removable installation of the hair clip on the heating barrel, wherein the locking unit comprises: a locking lever rotatably coupled to a first end of the opening of the holder; and a locking loop rotatably coupled to the locking lever and selectively locked to a second end of the opening of the holder, and wherein the holder is provided with a locking hook in the second end thereof, the locking hook being bent outward such that the locking hook can lock the locking loop by hooking the locking loop.

2. The removable hair clip for the hair iron as set forth in claim 1, the hair clip further comprising a pressure clip body resiliently rotating on a hinge on the cylindrical holder and extending to a distal end.

3. The removable hair clip for the hair iron as set forth in claim 2, wherein the clip body extends next to and can resiliently contact the heating barrel.

4. The removable hair clip for the hair iron as set forth in claim 2, the hair clip further comprising a manipulation lever, wherein the pressure clip body is controlled by the manipulation lever between a first position wherein the pressure clip body applies pressure to the hair to hold the hair on the heating barrel and a second position wherein the pressure applied to the hair by the pressure clip body is released.

5. The removable hair clip for the hair iron as set forth in claim 4, wherein the manipulation lever comprises a biasing means that maintains the pressure clip body in the first position when force is not applied to the manipulation lever.

* * * * *